US005781944A

United States Patent [19]

Huang

[11] Patent Number: 5,781,944

[45] Date of Patent: Jul. 21, 1998

[54] FOLDABLE DEVICE FOR A CRIB

[76] Inventor: Li-chu Chen Huang, No. 99, Fuchou 7th St., Chiayi City, Taiwan

[21] Appl. No.: 787,446

[22] Filed: Jan. 22, 1997

[51] Int. Cl.[6] ..... A47D 13/06; A47D 7/00

[52] U.S. Cl. ..... 5/99.1; 5/98.1

[58] Field of Search ..... 5/99.1, 93.1, 98.1

[56] References Cited

U.S. PATENT DOCUMENTS 5,483,710 1/1996 Chan ..... 5/99.1
5,530,977 7/1996 Wang ..... 5/99.1
5,611,634 3/1997 Wang ..... 5/99.1

*Primary Examiner*—Alexander Grosz
*Attorney, Agent, or Firm*—Dellett and Walters

[57] ABSTRACT

A foldable device for a crib enables the crib to be folded for storage. The foldable device includes an upper foldable member to which a number of transverse bars pivotally connected with a number of vertical bars are pivotally connected thereto and a lower foldable member to which a number of transverse arms pivotally connected with the number of vertical bars are pivotally connected therewith. With the upper foldable member and the lower foldable member, the crib of the invention is able to be folded.

5 Claims, 7 Drawing Sheets

FOLDABLE DEVICE FOR A CRIB

FIELD OF THE INVENTION

The present invention generally relates to a foldable device for a crib, and more particularly to a foldable device pivotally connected with two arms on two opposed sides of the crib, the arms being retained in position when receiving a load thereon. When a load onto the device is removed, the foldable device mounted on the crib enables the crib to be folded.

BACKGROUND OF THE INVENTION

Conventional cribs for babies are either made of wood or of plastic, the structure of which is not foldable. These cribs have a disadvantage in that parents may worry about an unintentional collapse of a foldable crib and therefore may not let babies play inside the crib. Although having a rigid crib is safe for babies, the crib will take up a very large space when in storage. These cribs have another disadvantage, therefore, that families having not much space for storage cannot store the cribs.

From the previous description, it is noted that a crib having a rigid structure is unable to fulfill the practical requirements of modern families. Thus, a foldable device for a crib constructed in accordance with the present invention tends to mitigate and/or obviate the aforementioned problems.

SUMMARY OF THE INVENTION

The main objective of the invention is to provide a foldable device for a crib. The foldable device mounted on a crib enables the crib to be folded when a load thereon is removed. The foldable device has an upper folding member so that an upper frame of the crib is able to be folded, and a lower folding member so that a lower frame of the crib is able to be folded. The upper folding member includes a first housing having a first space defined therein for respectively and pivotally receiving two opposed ends of the upper frame arms, a pair of retainers each having a stepped part protruding outward, and a first extension integrally formed therewith, a receptacle having two pairs of through holes defined therein for pivotally receiving the pair of retainers therein and a spring securely and respectively received between the pair of retainers. The lower folding member includes a plurality of joints and each of which has at least two bottom supports pivotally received therein, such that when the upper folding member is folded, the lower folding member will be able to be correspondingly folded and the size of the crib will be minimized. Therefore, after the load onto the crib is removed from the crib, the base of the crib will be able to be folded by a user by simply lifting a handle formed on to the bottom supports.

The two opposed ends of the upper frame arms are normally retained by the first extension of the pair of retainers. When the receptacle is being pressed into the first space of the first housing to collapse the crib, two side faces of the receptacle will slide over the stepped part of the pair of the retainers and thus the retainers will be forced to converge toward each other and be received within the third space of the receptacle and the spring is correspondingly compressed. Accordingly, the two opposed ends of the upper frame arms will leave the retainment of the first extension of the retainers, such that the two opposed ends of the upper frame arms are able to be pivoted about the first housing. To assemble the crib, both of the opposed arms pivotally connected between the upper folding member are pressed downward, such that each end of the opposed ends of the frame arms will slide over the stepped part of each of the retainers and finally be retained by the first extension of the pair of retainers and that the upper frame of the crib is established.

Another objective of the invention is to provide a foldable device for a crib, which enables the crib to be folded and thus minimize its space for storage.

Other objects, advantages and novel features of the invention will become more apparent from the following detailed description when taken in conjunction with the accompanying drawings.

BRIEF DESCRIPTION OF THE DRAWINGS

The present invention will now be better understood with reference to the following drawings, wherein.

DETAILED DESCRIPTION OF THE PREFERRED EMBODIMENT

Figure 1:
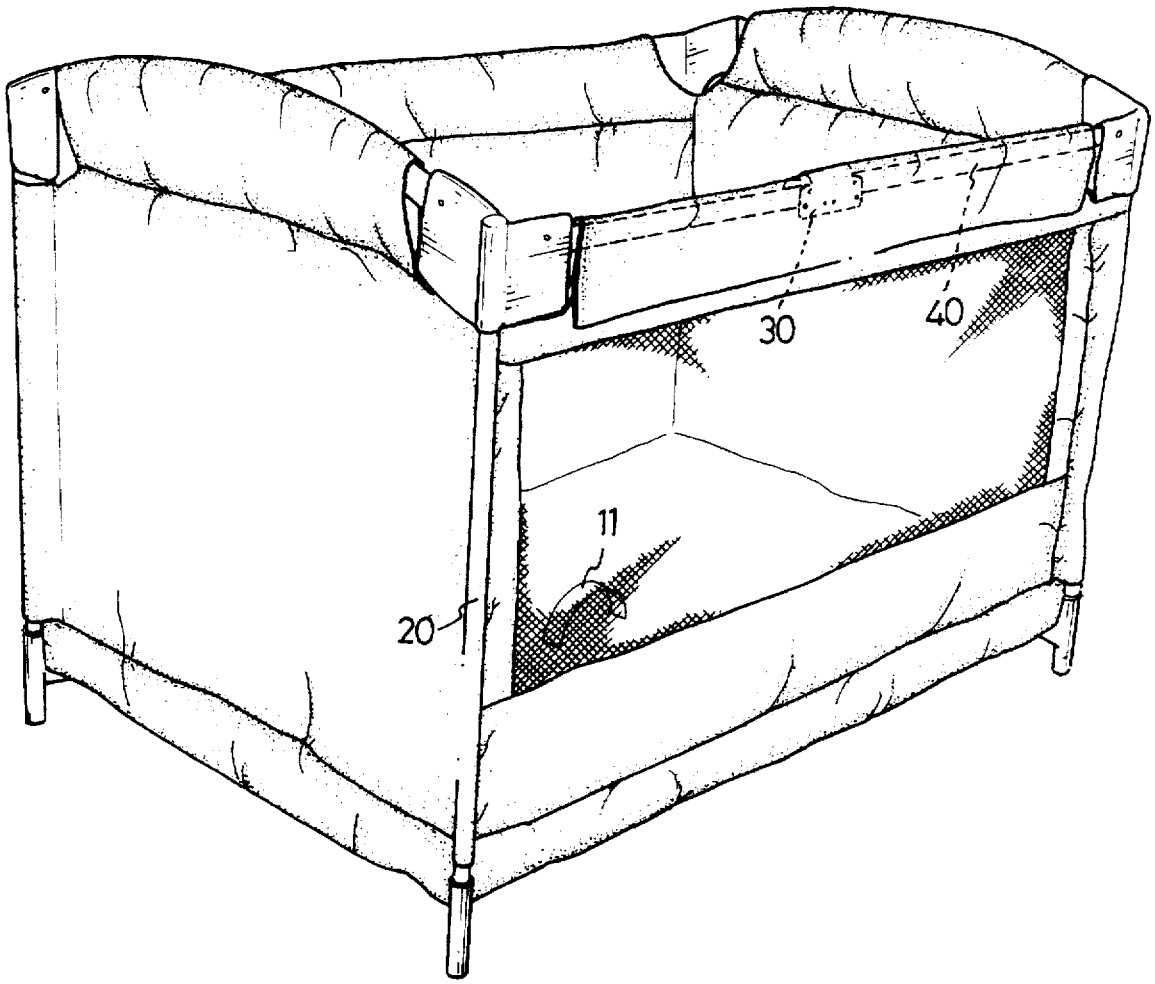
FIG. 1 is a perspective view of a crib having a foldable device mounted thereon.
Figure 2:
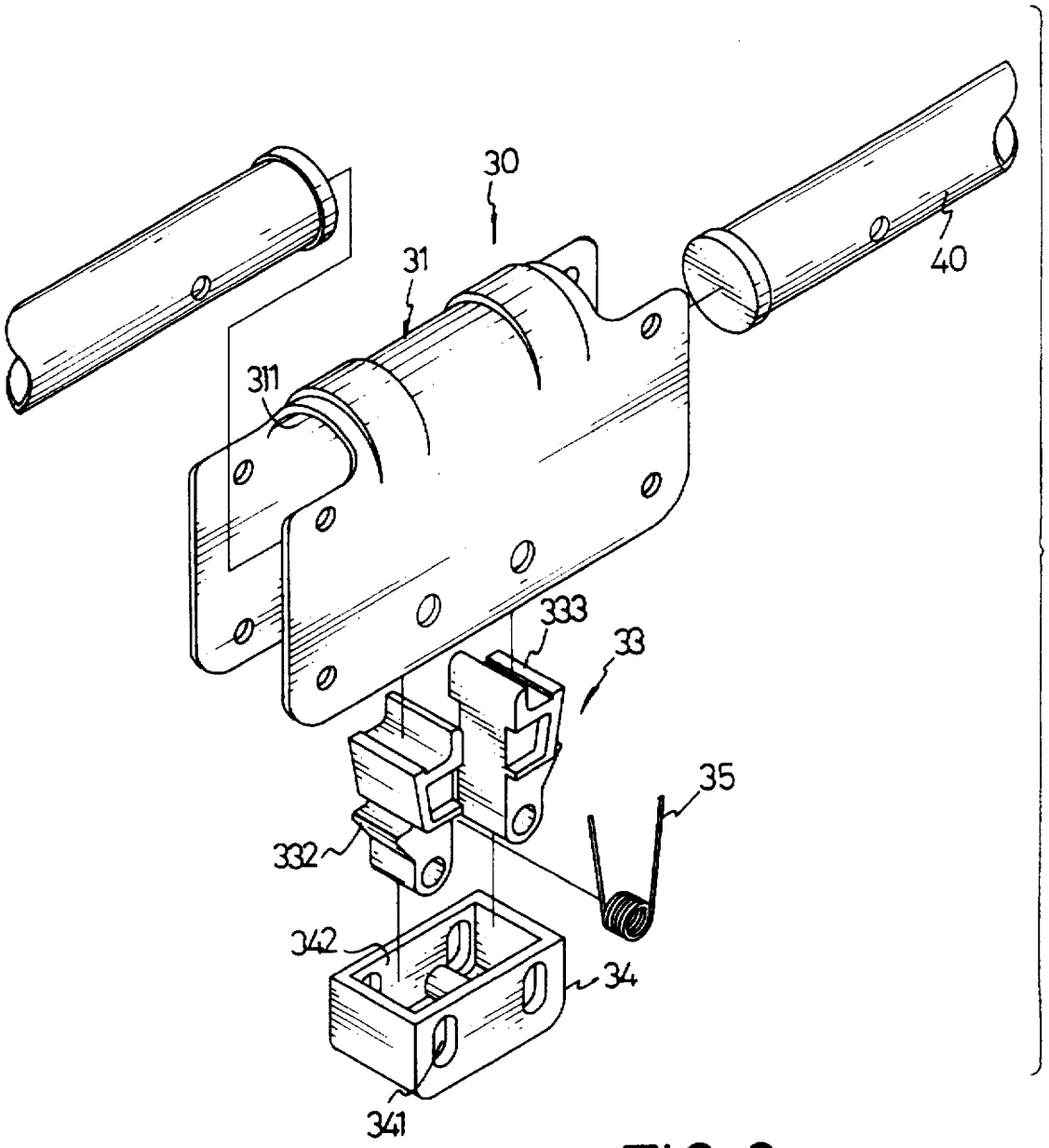
FIG. 2 is an exploded view of an upper folding member constructed in accordance with the present invention.
Figure 5:
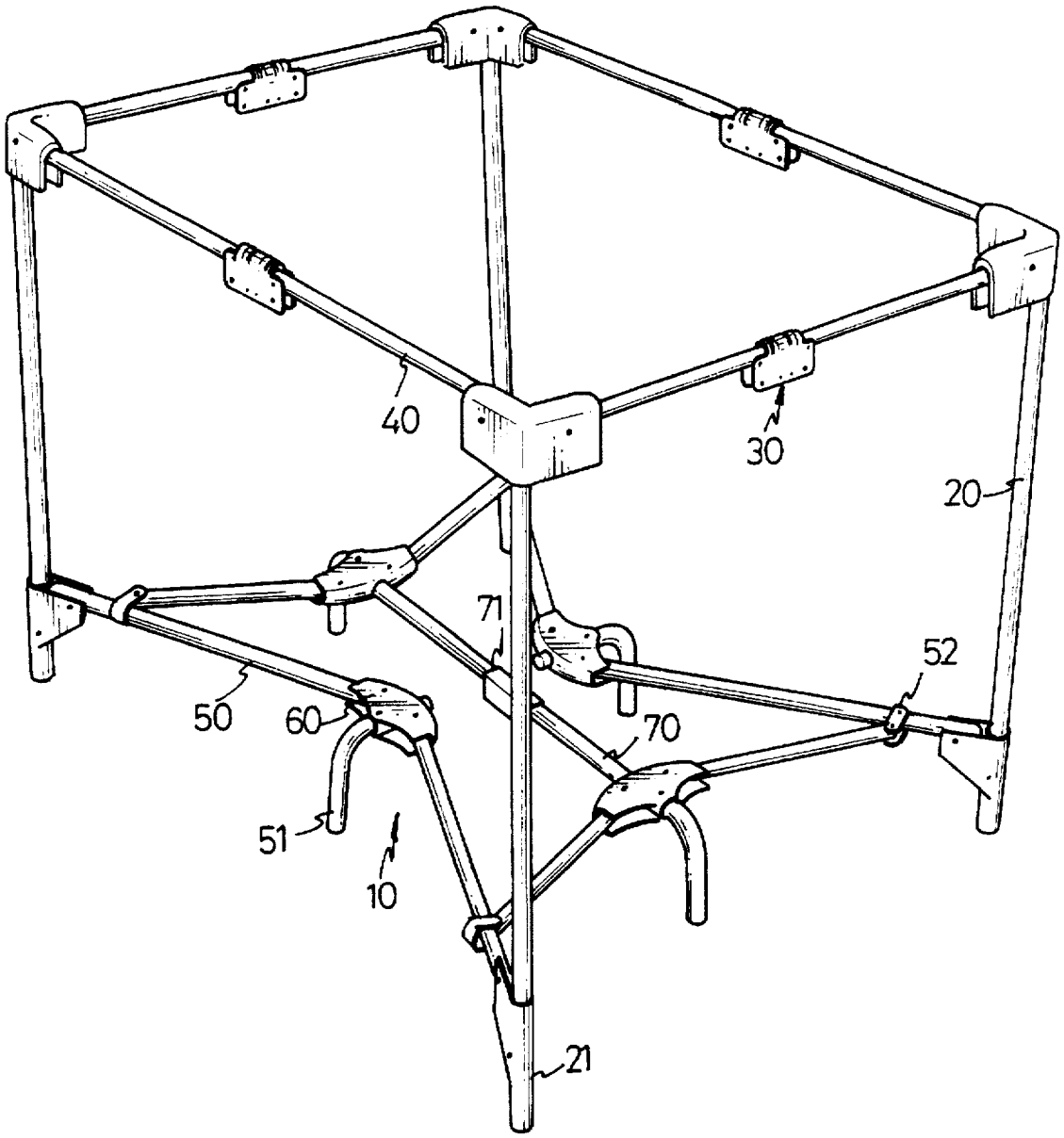
FIG. 5 is a perspective view of the crib showing the disposition of upper folding members and lower folding members.

Referring to FIGS. 1, 2 and 5, a foldable device having an upper foldable member 30 and a lower foldable member 10 for a crib constructed in accordance with the present invention is shown. The crib is configured to have four pairs of arms 40 each pair of which has an upper foldable member 30 pivotally connected therebetween, four rods 20 each mounted between a joint of every two pairs of arms 40, and four pairs of lower arms 50 each pair of which has a lower foldable member 10 pivotally connected therebetween. The upper foldable member 30 includes a first housing 31 having a first space 311 defined therein for respectively and pivotally receiving two opposed ends 41 of the arms 40, a pair of retainers 33 each having a stepped part 332 protruding outward, a second space 331 defined therein and a first extension 333 integrally formed therewith, a receptacle 34 having two pairs of through holes 341 defined therein for pivotally receiving the pair of retainers 33 therein and a spring 35 securely and respectively received between the second spaces 331 of the pair of retainers 33. The upper foldable member 30 will hold the opposed ends 41 of the arms 40 in position when two side faces (not numbered) of the two ends 41 are both abutted by the first extensions 333 of the pair of the retainers 33 and the help of an inner periphery of the first housing 31, as shown in FIG. 3.

Figure 3:
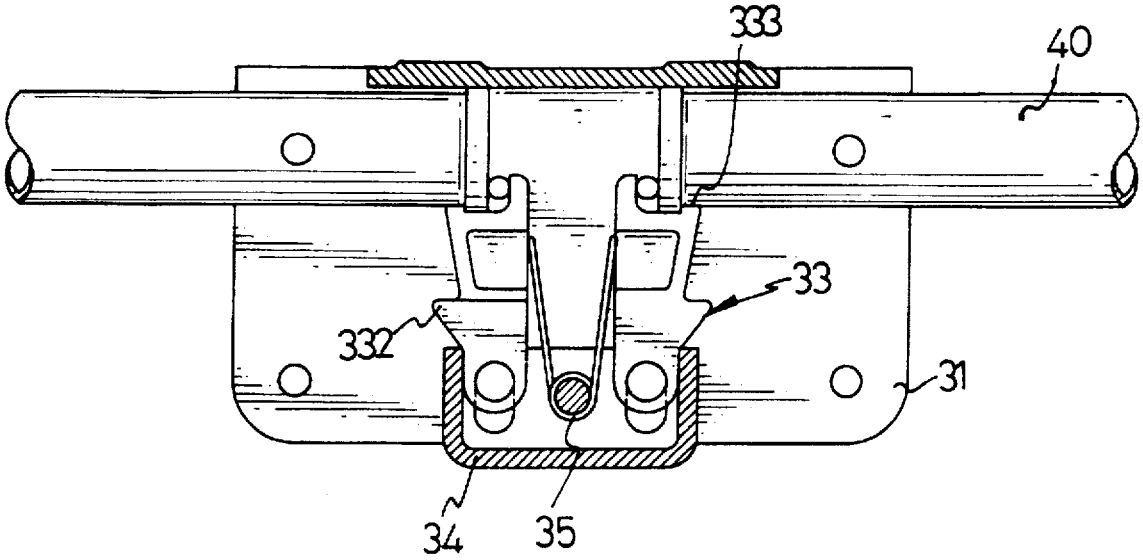
FIG. 3 is a partial sectional view of the upper folding member as shown in FIG. 2.
Figure 4:
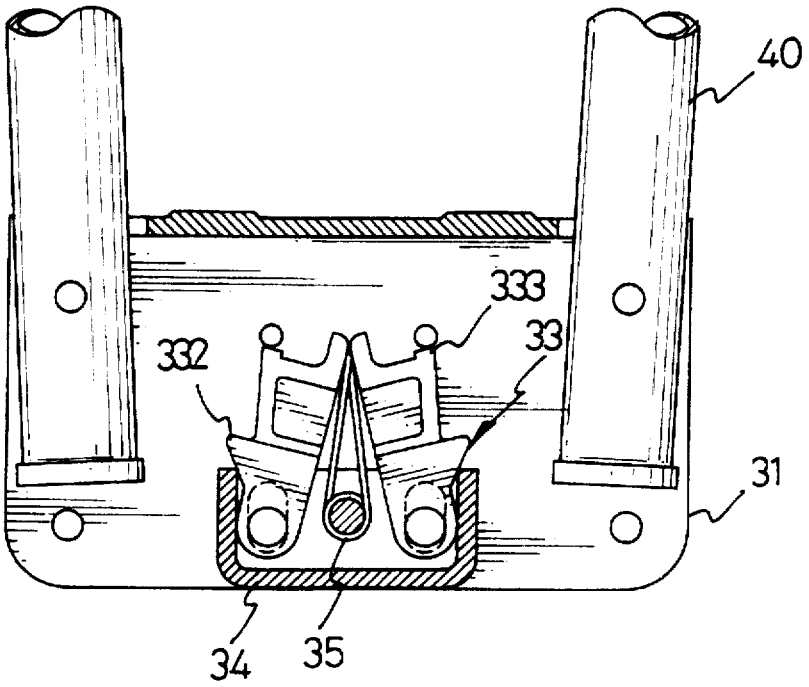
FIG. 4 is a schematic view showing two arms pivoted about a first housing when a receptacle is pressed into a first space of a first housing.

Referring to FIGS. 3 and 4, the two arms 40 are freely pivoted in the first housing 31 when the receptacle 34 is pressed toward the first space 311 of the first housing 31 and the retainers 33 are received within a third space 342 which is defined between inner faces of the receptacle 34. This position of the receptacle permits a movement of each of the pair of retainers 33 toward each other by means of two opposed faces of the receptacle 34 sliding over the stepped part 332 of the retainers 33, such that each of the pair of the retainers 33 is forced to move toward each other and each end 41 of the arms 40 originally abutted by the first extension 333 of the retainers 33 will thus leave the abutment of the first extension 333. It is to be noted that when the two retainers 33 are forced to move toward each other, the spring 35 securely received between side faces of the retainer 33 is compressed. When the pressing force acting onto the receptacle 34 is removed, the resilient force of the spring 35 will automatically and partially eject the retainers 33 out and restore the receptacle 34 to its original position.

Figure 6:
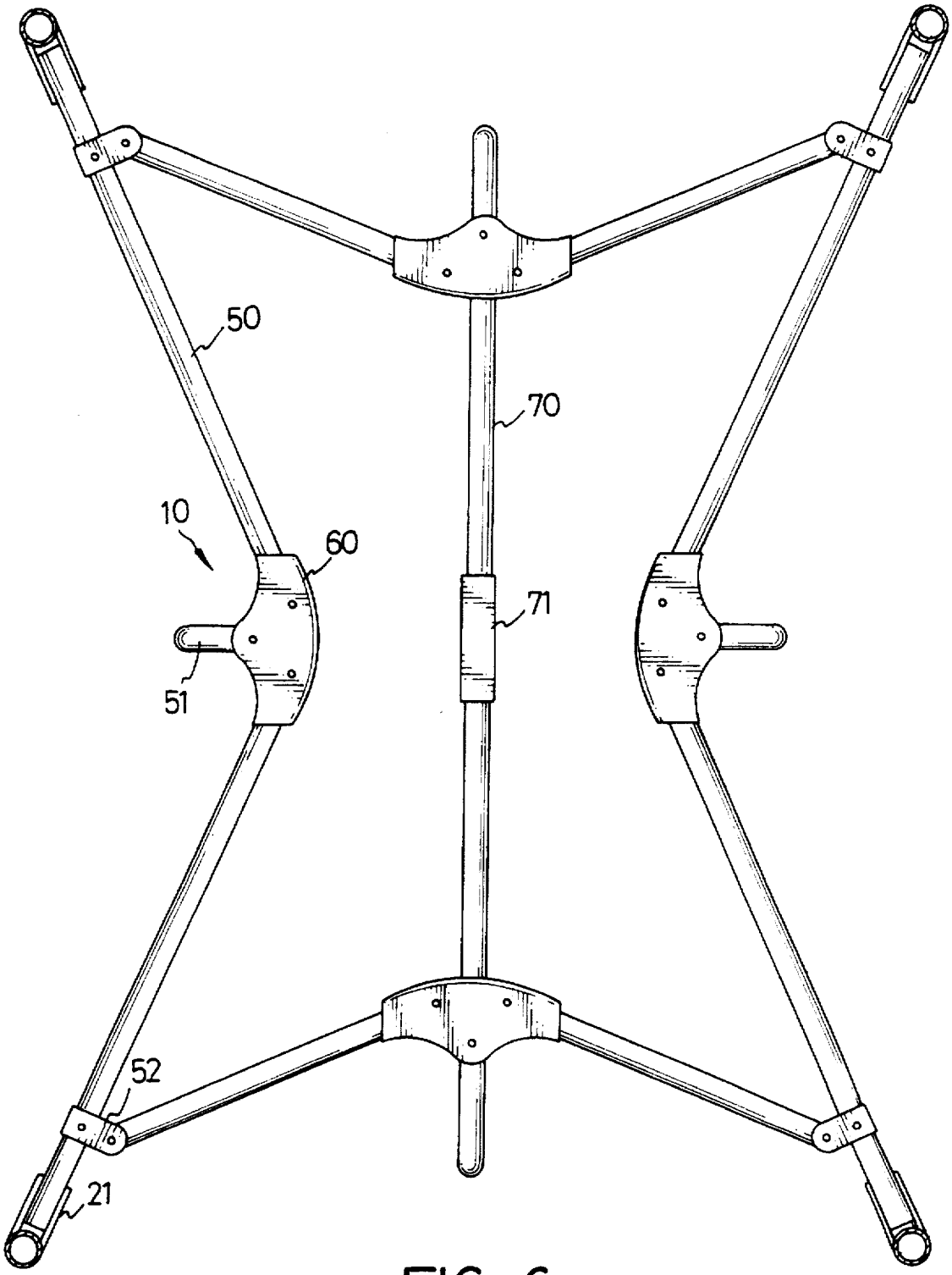
FIG. 6 is a schematic top plan view showing a lower folding member constructed in accordance with the present invention.

Referring to FIGS. 5 and 6, the lower foldable member 10 of the invention is designed to have a plurality of joints 60 each defining a plurality of pairs of through holes (not numbered) therein, four pairs of lower arms 50, each pair of the lower arms 50 being opposedly and pivotally received within the joint 60, four side arms 51 each of which is mounted within the joint 60 and between the two opposed lower arms 50, and a pair of bottom beams 70 whose first ends are pivotally connected with each other via a connector 71 and whose second ends are mounted within a respective joint 60. It is noted from FIGS. 5 and 6 that except for the side arms 51 and the pair of bottom beams 70, every one of the lower arms 50 is pivotally connected with another lower arm 50 by means of a retainer 52, and four free ends of the lower arms 50 are respectively and pivotally received with a foot 21 which also respectively has one free end of the rod 20 securely received therein.

Figure 7:
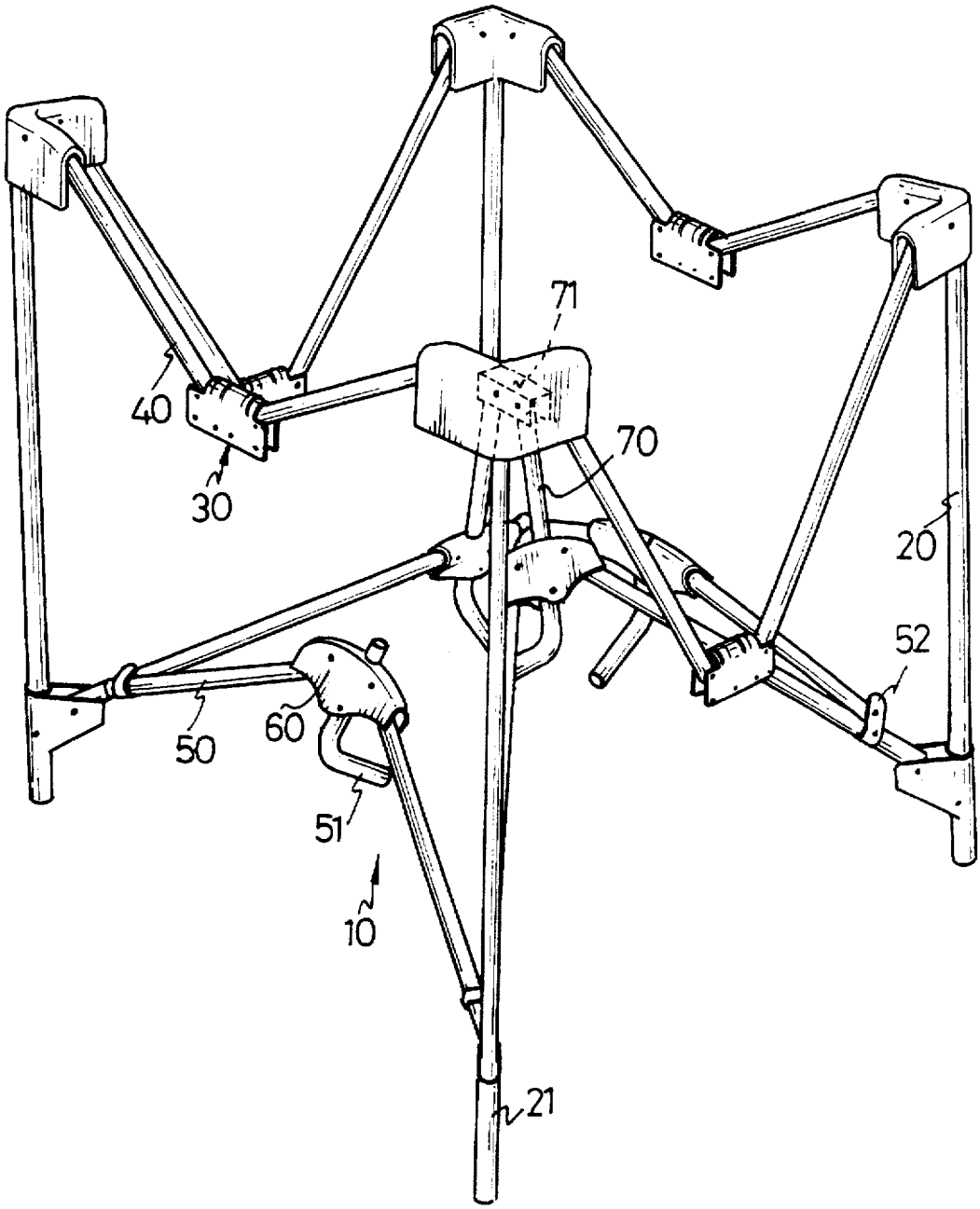
FIG. 7 is a schematic view showing a folding process of the upper folding member and the lower folding member.
Figure 8:
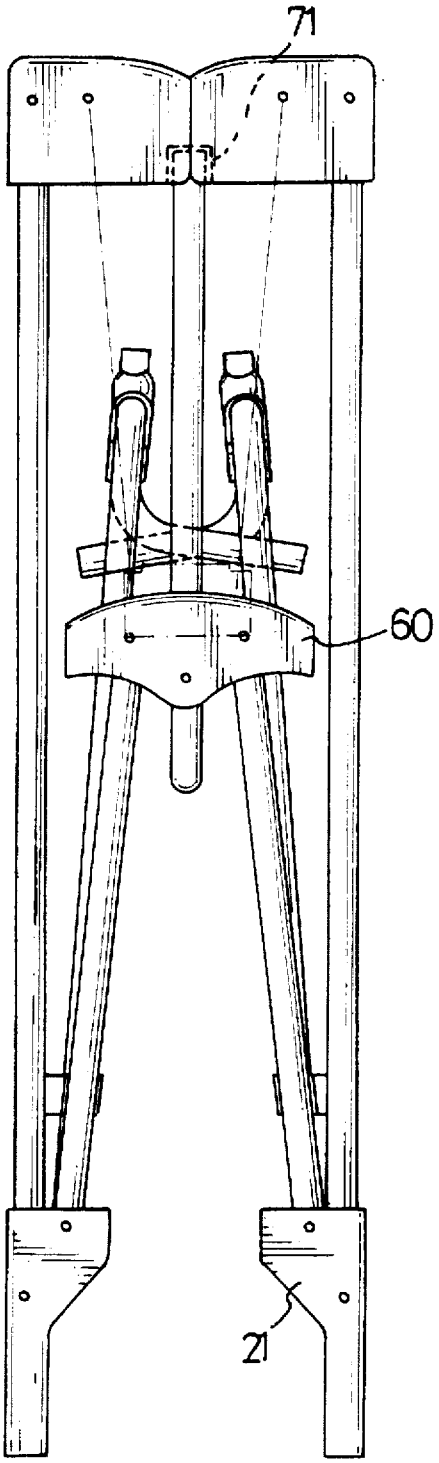
FIG. 8 is a schematic view showing a folded formation of the crib.
Figure 9:
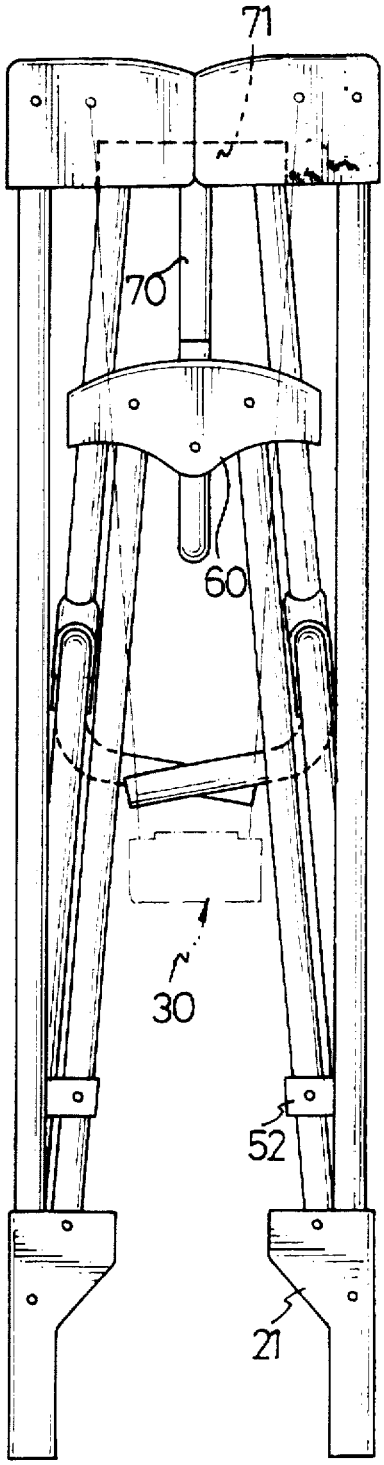
FIG. 9 is another schematic view showing another side of the crib in folded formation.

Referring to FIGS. 1 and 7, when each one of the receptacles 34 of the upper foldable member 30 is pressed inward into the first space 311 of the first housing 31, the respective arm 40 pivotally connected on both sides of the upper foldable member 30 is then able to be folded. Afterwards, a user will only have to pull a handle 11 provided on a cover (not numbered) of the crib upward and the lower arm 50 will be able to be pivoted, which causes the joints 60 to become close to each other. Yet, because of the relationship between each of the lower arm 50 and the foot 21, when the handle 11 is being pulled upward, the joints 60 are not only converged to each other but also have a movement in the axial direction. When the folding process of the crib is finished, the size of the crib is minimized so that the crib will be easily handled for storage. It is noted that the upper foldable member 30 and the lower foldable member 10 are adjacent to each other when the receptacle 34 of the upper foldable member 30 is pressed into the first space 311 of the first housing 31 and after the load acting onto the lower foldable member 10 has been removed. With such a configuration, the crib takes up only a little space when compared to the prior cribs.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A foldable device for a crib comprising: an upper foldable member having:

four pairs of arms (40) each pair of which is pivotally received within said upper foldable member;

two opposed ends (41) of a pair of said arms (40);

a first housing (31) having a first space (311) defined therein for respectively and pivotally receiving said two opposed ends (41);

a pair of retainers (33) movably received within said first housing and each retainer having a stepped part (332) protruding outward, a second space (331) defined therein and a first extension (333) integrally formed therewith for releasably abutting said opposed ends;

a receptacle (34) having two pairs of through holes (341) defined therein for pivotally receiving the pair of said retainers therein and being adapted to releasably engage said stepped part of said retainers; and a third space (342) defined between an inner face of said receptacle and end faces of said retainers for movably receiving said retainers therein; and a spring (35) securely and respectively received between said second spaces of each of said retainers; and a lower foldable member (10) having:

a plurality of joints (60) each of which has defined therein at least three pairs of through holes;

four pairs of lower arms (50) each pair of which is pivotally received in both sides of each of said joint via two of said through holes; and four side arms (51) each of which is securely received between two respective lower arms and within said joint.

2. The foldable device for a crib as claimed in claim 1, wherein said lower foldable member further comprises four retainers (52) each of which is mounted on one of said lower arm and has another lower arm pivotally received therein.

3. The foldable device for a crib as claimed in claim 1, wherein said lower foldable member further comprises four feet (21) each of said feet having one of said lower arms pivotally received therein.

4. The foldable device for a crib as claimed in claim 1, wherein said retainers (52) are movably received along said through holes of said receptacle.

5. The foldable device for a crib as claimed in claim 1, wherein a handle (11) is integrally formed on a base of said crib.

* * * * *